United States Patent [19]

Gangnath

[11] 4,141,371

[45] Feb. 27, 1979

[54] HAIR ROLLER

[75] Inventor: Robert B. Gangnath, Monroe, Conn.

[73] Assignee: Sperry Rand Corporation, Bridgeport, Conn.

[21] Appl. No.: 741,923

[22] Filed: Nov. 15, 1976

[51] Int. Cl.[2] ..... A45D 2/00

[52] U.S. Cl. ..... 132/40

[58] Field of Search ..... 132/40, 41, 42; 229/41 R

[56] References Cited

U.S. PATENT DOCUMENTS

| | | | |
|---|---|---|---|
| 1,990,788 | 2/1935 | Kells | 229/41 R |
| 2,080,105 | 5/1937 | Bacon | 229/41 R |
| 2,109,716 | 3/1938 | Annen | 229/41 R |
| 2,551,090 | 5/1951 | Bergstein | 229/41 R |
| 3,260,267 | 7/1966 | Rubenstein et al. | 132/40 |
| 3,438,562 | 4/1969 | Connor et al. | 229/41 R |
| 3,713,455 | 1/1973 | Chen | 132/40 |
| 4,022,226 | 5/1977 | Muenstermann | 132/39 |

FOREIGN PATENT DOCUMENTS

| | | | |
|---|---|---|---|
| 18438 of | 1911 | United Kingdom | 229/41 R |

*Primary Examiner*—G.E. McNeill

*Attorney, Agent, or Firm*—Charles R. Miranda; Joseph S. Failla

[57] ABSTRACT

An improved hair roller is described which is adapted to be expanded from a substantially flat configuration into an elongated cylindrically shaped body which is substantially resistant to bending and buckling. The hair roller includes first and second hinge coupled, flexible planar shaped roller members each having substantially the same cross sectional configuration and dimensions. An edge of each roller member is hinge coupled to a surface of the other roller member and the hinge coupled members are resiliently deflectable into a body having a generally cylindrical configuration. Fastener means are provided for fastening the body in the cylindrical configuration.

5 Claims, 4 Drawing Figures

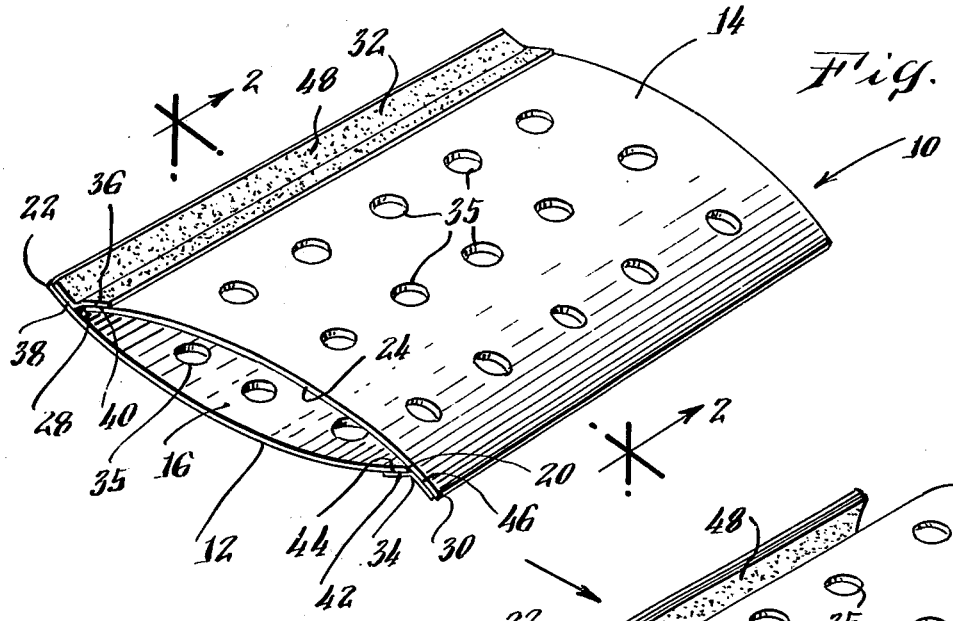
Fig. 1.
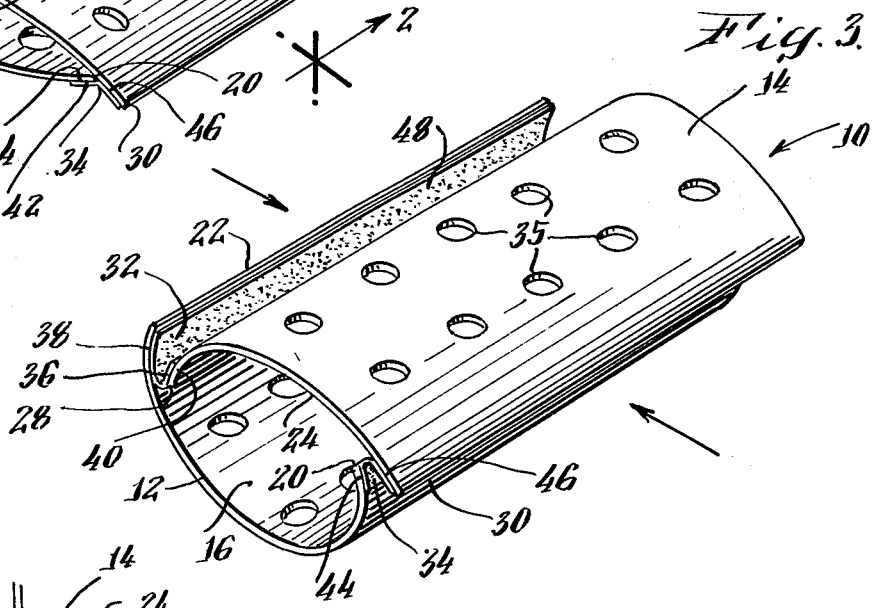
Fig. 3.
Fig. 2.
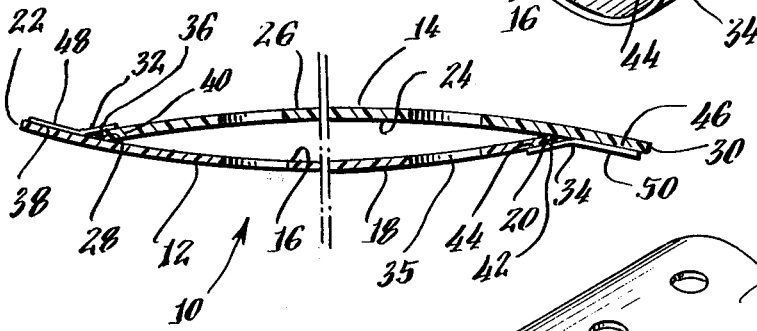
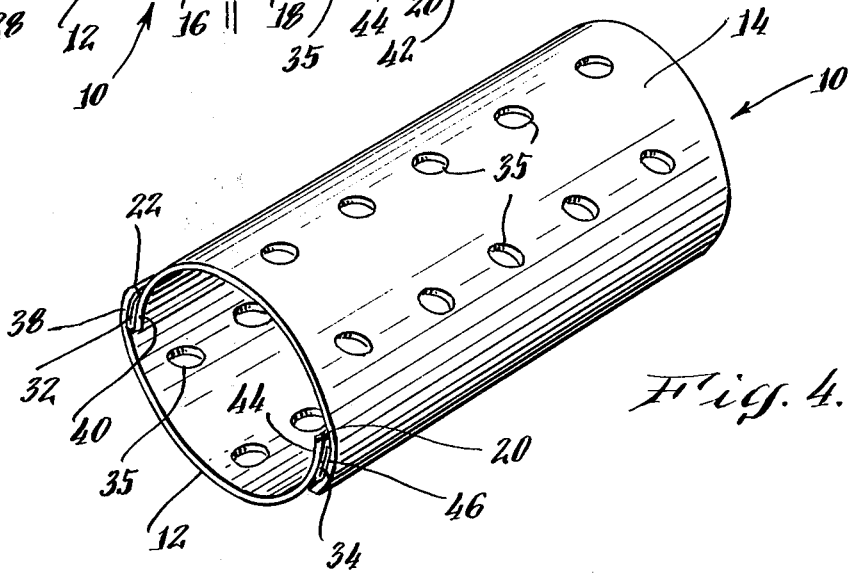
Fig. 4.

HAIR ROLLER

BACKGROUND OF THE INVENTION

This invention relates to hair rollers and, more particularly, to an improved form of cylindrically shaped hair roller which may be stored flat.

The use of rollers for the styling and setting of hair is well known. In one arrangement, a hair roller body, which is generally cylindrically shaped is provided and a person's hair is wound about and secured to the roller body. The hair thus formed on the roller body can be warmed to enhance setting. Alternatively, the hair remains wound about the roller body for an extended period of time to achieve setting under ambient air conditions.

An improved form of hair roller of this type comprises first and second generally planar shaped hinge coupled roller members. A hair roller of this type is disclosed in copending U.S. Patent application Ser. No. 741,611 which is filed concurrently herewith and is assigned to the assignee of this invention. In one particular arrangement of this type, longitudinally extending edges of one of the roller members are hinge coupled to a surface of the other member and the members are secured in a cylindrically shaped configuration by a fastener means. Hinge coupling of both edges of one roller member to a surface of the other roller member requires that one roller member be relatively more narrow in width than the other member. This need to provide two roller members of relatively different sizes increases the cost of the hair roller in terms of production and inventory relative to the cost of a hair roller having roller members of the same general size.

Accordingly, it is an object of this invention to provide an improved hair roller of the type described having roller members of substantially the same dimensions.

SUMMARY OF THE INVENTION

A hair roller adapted to be expanded from a substantially flat configuration into an elongated cylindrically shaped body which is substantially resistant to bending and buckling comprises first and second hinge coupled planar shaped roller members each having substantially the same cross sectional configuration and size. The first planar shaped roller member has a first surface and first and second longitudinally extending edges. The second planar shaped roller member has a first surface with first and second longitudinally edges. Hinge coupling means provide hinge coupling between the first edge of the first roller member and the first surface of the second roller member, and, between the first edge of the second roller member and the first surface of said first member. The first surfaces of the roller members are positioned in juxtaposed relationship and the coupled roller members are resiliently deflectable from a generally planar configuration into a body having a generally cylindrically shaped configuration. A fastening means is provided for maintaining the body in the deflected, cylindrically shaped configuration. With this arrangement, roller members of the same general dimensions are provided and the cost of the hair roller is reduced.

BRIEF DESCRIPTION OF THE DRAWING

These and other objects and features of the invention will become apparent with reference to the following specification and the drawings wherein:

FIG. 1 is a perspective view of a hair roller constructed in accordance with features of the present invention and which illustrates the hair roller in an undeflected, generally planar configuration for storage;

FIG. 2 is a fragmentary sectional view taken along plane 2—2 of FIG. 1;

FIG. 3 is a perspective view of the hair roller of FIG. 1 and illustrates the hair roller after an intermediate step during the process of bending the roller into a body having a generally cylindrically shaped configuration; and, FIG. 4 is a perspective view of the hair roller of FIG. 1 illustrating the hair roller deflected and fastened into a body having a generally cylindrically shaped configuration.

DETAILED DESCRIPTION

Referring now to the drawings, a hair roller 10 is provided which is adapted to be expanded from a substantially flat configuration as illustrated in FIGS. 1 and 2 into an elongated body having a generally cylindrically shaped configuration which is substantially resistant to bending and buckling. The hair roller 10 comprises a first flexible, planar shaped roller member 12 and a second flexible, planar shaped roller member 14. The first roller member 12 has a first surface 16, a second opposite surface 18, a first edge 20 and a second edge 22. The second roller member 14 has a first surface 24, a second opposite surface 26, a first edge 28 and a second edge 30.

A means comprising first and second adhesive strips 32 and 34, respectively provides a hinge coupling between the edge 20 and the surface 24 and between the edge 28 and the surface 16. This hinge coupling provides for juxtaposed positioning of the surfaces 16 and 24 when the hair roller 10 is collapsed in the generally planar configuration of FIGS. 1 and 2 and enables the members to be resiliently deflected from the planar configuration into a body having the generally cylindrically shaped configuration of FIG. 4.

The first adhesive strip 32 has a first adhesive surface 36 thereof which is positioned adjacent to and adheres to a longitudinal segment 38 of the first surface 16 of the first roller member 12 and to a longitudinal segment 40 of the second surface 26 of the second roller 14. The second adhesive strip 34 includes a first adhesive surface 42 which is positioned adjacent to and adheres to a longitudinal segment 44 of the second surface 18 of the first roller member 12 and to a longitudinal segment 46 of the first surface 24 of the second roller member 14. In an alternative arrangement (not illustrated), the hinge coupling is provided by strips which are heat sealed to the longitudinal segments 38, 40, 44 and 46.

The hair roller members 12 and 14 are formed of materials and are dimensioned for providing the desired resilient deflectivity. While various materials may be provided, the members are formed in one arrangement from a sheet of a polymer plastic such as polypropylene having a thickness in the range of 0.010 to 0.015 inches (0.025 cm to 0.038 cm). The members are generally rectangular shaped as illustrated in FIG. 1 and because of the offset relationship between the surfaces of the members and the hinge coupling, the members 12 and 14 may be of the same length and width and are deflectable to provide a body of generally circular cross sectional configuration. A plurality of apertures 35 are formed in the members 12 and 14 to enhance air flow and application of hair treatment material.

A fastener means is provided for maintaining the body of FIG. 4 in a cylindrical configuration. The fastener means is also provided by the adhesive strips 32 and 34 which are doubled sided adhesive strips. The strip 32 includes a second side 48 which fastens the longitudinal segments 38 and 40 of the members 12 and 14 respectively when the strip is folded over upon itself as illustrated in FIGS. 3 and 4. Similarly, the second strip 34 includes a second side 50 which fastens the longitudinal segments 44 and 46 when the strip 34 is folded over on itself as illustrated in FIGS. 3 and 4. When heat sealed strips are alternatively employed for hinge coupling, a fastening means is provided by an adhesive coating on sides 48 and 50 of the strips.

The widths of segments of the adhesive strip surfaces 36 and 42 adhering to longitudinal segments 38 and 46 respectively are greater than the widths of segments of the same adhesive strip surfaces which adhere to longitudinal segments 40 and 44, respectively. Adhesion of hair wound about the roller is thereby avoided. Strips of release paper, not illustrated for clarity in the drawing, are provided on the exposed adhesive surfaces 48 and 50 to inhibit adhesion between flat, stacked hair rollers.

The described hair roller 10 is particularly advantageous in that it is formed of roller members 12 and 14 which can be formed to have the same shape and cross sectional dimensions and which, by virtue of the offset hinge coupling, enables a user to, with one hand, deflect the members into a body having a generally cylindrically shaped configuration.

While there has been described a particular embodiment of the invention, it will be apparent to those skilled in the art that variations may be made thereto without departing from the spirit of the invention and the scope of the appended claims.

What is claimed is:

1. A hair roller resiliently expandable from a substantially flat storage configuration into an elongated cylindrical shaped configuration which is substantially resistant to bending and buckling to externally applied finger force when readied for use, said hair roller comprising in combination, a. a pair of resiliently flexible rectangular-shaped substantially flat body members having substantially the same length and width arranged in a laterally offset substantially flat overlying relationship to each other, b. each of said body members having opposed corresponding elongated marginal portions terminating in longitudinally extending edges, said marginal portions being arranged in a laterally offset relationship to each other with said marginal portions being arranged in adjacent parallel pairs, one of the longitudinal edges within each of said adjacent pairs being laterally offset with respect to the other longitudinal edge of said adjacent pairs forming a pair of laterally opposed offset longitudinal edges, c. means secured to each of said offset marginal portions in bridging relationship to each of said laterally recessed longitudinal edges of each of said adjacent pairs for hinge coupling said body members to each other along said laterally offset marginal portions forming a hinge coupled hair roller having a pair of laterally opposed hinges and a substantially flat storage configuration, said hinge coupled body members being resiliently deflectable from said substantially flat overlying relationship to an arcuate shaped spaced apart relationship to form a hair roller having a generally cylindrical-shaped configuration, and d. means arranged on said hinge coupling means for maintaining said hair roller in said deflected cylindrical shaped configuration.

2. The hair roller of claim 1 wherein said maintaining means releasably maintain said hair roller in said cylindrical shaped configuration and upon release of said maintaining means the resiliency of said body members in cooperation with said pair of opposed hinges urge said hair roller into said substantially flat storage configuration.

3. The hair roller of claim 2 wherein said hinge coupling means include a pair of elongated strip members having opposed first and second surfaces, each of said strip members being positioned in said bridging relationship to the offset longitudinal edges of the offset body members and in contact with the corresponding opposed marginal portions of said body members.

4. The hair roller of claim 3 wherein each of said body members have substantially the same thickness and each of the marginal portions of said offset body members have a first surface, the first surface of the marginal portion of one of said offset body members being spaced from the first surface of the marginal portion of the other of said body members by the thickness of the body member, and an adhesive material applied to the first surface of each of said pair of strip members for securing the strip members to each of said body members.

5. The hair roller of claim 4 wherein each of said pair of elongated strip members is folded over longitudinally thereof with the second surface of each of the strip members being arranged in a face to face contacting relationship when said hinge coupled body members are deflected to form said hair roller body, and said means for maintaining said hair roller body in said deflected configuration include adhesive material applied to the second surface of each of said strip members.

* * * * *